US006880739B1

(12) United States Patent
Zhu

(10) Patent No.: US 6,880,739 B1
(45) Date of Patent: Apr. 19, 2005

(54) POWERED NAIL-DRIVING TOOL WITH AN ANGLE-ADJUSTABLE NAIL MAGAZINE

(76) Inventor: Yimin Zhu, 3-3, No. 195-1, Ko-Yuan Erh St, Chiu-Lung-Po Dist., Chung-Ching City (CN)

( * ) Notice: Subject to any disclaimer, the term of this patent is extended or adjusted under 35 U.S.C. 154(b) by 0 days.

(21) Appl. No.: 10/848,011

(22) Filed: May 19, 2004

(30) Foreign Application Priority Data

Dec. 18, 2003 (TW) ..... 92222180 U

(51) Int. Cl.[7] ..... B25C 1/04

(52) U.S. Cl. ..... 227/109; 227/119; 227/120; 227/136

(58) Field of Search ..... 227/10, 120, 109, 227/119, 136, 135

(56) References Cited

U.S. PATENT DOCUMENTS 4,136,810 A * 1/1979 Bull ..... 227/120
5,238,167 A * 8/1993 Howard et al. ..... 227/110
5,437,404 A * 8/1995 Shkolnikov ..... 227/109
5,579,975 A * 12/1996 Moorman ..... 227/8
6,006,975 A * 12/1999 Ishizawa ..... 227/119
6,431,428 B1 * 8/2002 Chen ..... 227/120
6,708,860 B1 * 3/2004 Thieleke ..... 227/8
6,769,591 B1 * 8/2004 Yamamoto et al. ..... 227/113
6,789,718 B1 * 9/2004 Canlas et al. ..... 227/130

* cited by examiner

*Primary Examiner*—Scott A. Smith
(74) *Attorney, Agent, or Firm*—Harness, Dickey & Pierce, P.L.C.

(57) ABSTRACT

A powered nail-driving tool includes a striking rod disposed in a shell and thrust into a feeding region of a nail-discharging passage in a barrel along an impact line to force a leading nail of a selected one of ranks of nails oriented along different lines of inclination. A nail magazine has a nail-feeding channel for accommodating the selected rank of nails. A linking arm is secured to a leading edge wall of the magazine, and is pivotally mounted on the barrel such that the magazine is turnable so as to permit the inclination line of the selected rank to align with the impacting line. Thus, the tool can be used for driving different ranks of nails.

8 Claims, 9 Drawing Sheets

POWERED NAIL-DRIVING TOOL WITH AN ANGLE-ADJUSTABLE NAIL MAGAZINE

CROSS-REFERENCE TO RELATED APPLICATION

This application claims priority of Taiwanese Application No. 092222180, filed on Dec. 18, 2003.

BACKGROUND OF THE INVENTION

1. Field of the Invention

This invention relates to a powered nail-driving tool, more particularly to a powered nail-driving tool with a nail magazine which is adjustably retained to a barrel of a tool body so as to be suitable for ranks of nails oriented along different lines of inclination.

2. Description of the Related Art

Referring to FIG. 1, a conventional powered nail-driving tool is shown to include a body 6 with a shell 61 for receiving a striking rod 63, and a barrel 7 defining a nail-discharging passage 71 such that the striking rod 63 is thrust into the nail-discharging passage 71 to force a leading nail 9 out of the barrel 7 for nailing a workpiece. A handle 62 extends from the shell 61, and has a connector 65 to connect with a high-pressure air source. A nail magazine 8 has two ends connected to the barrel 7 and the handle 62, respectively, and has a nail-feeding channel 81 for accommodating a rank of nails 9. A biasing member (not shown) is disposed in the channel 81 to bias the nails 9 towards the nail-discharging passage 71. However, in practice, there are various ranks of nails used with the conventional powered nail-driving tools and oriented along different lines of inclination. Thus, tilting of the leading nail 9 fed into the nail-discharging passage 71 may occur so that the leading nail 9 cannot be forced out of the barrel 7. Therefore, the conventional powered nail-driving tool of such construction is merely suited for a certain rank of nails.

SUMMARY OF THE INVENTION

The object of the present invention is to provide a powered nail-driving tool which can be used for driving different ranks of nails with different lines of inclination.

According to this invention, the powered nail-driving tool includes a body which has a barrel and a shell opposite to each other along an impacting line. The barrel defines a nail-discharging passage which extends along the impacting line, and which has feeding and guiding regions proximate to and distal from the shell, respectively. The barrel has an access opening which is communicated with the feeding region in a radial direction relative to the impacting line, and which is adapted to admit entry of a leading nail into the feeding region. A striking rod is disposed in the shell, and is thrust into the feeding region along the impact line in response to a manual operation to thereby force the leading nail through the guiding region and out of the barrel for nailing. A handle extends radially from the shell, and includes proximate and distal segments relative to the shell. A nail magazine includes a leading edge wall which extends in a longitudinal direction, and which has proximate and distal edge ends opposite to each other in the longitudinal direction, a nail-feeding channel which is elongated in a transverse direction relative to the longitudinal direction, which has a proximate storing zone adjacent to the leading edge wall and a distal storing zone opposite to the proximate storing zone in the transverse direction, and which is adapted to accommodate a selected one of two different ranks of nails orienting along a corresponding one of the first and second inclination lines in such a manner that a head and a pointed end of the leading nail are respectively adjacent to the proximate and distal edge ends, and a torque-adjustable biasing member which is adapted to urge against a trailing nail such that the leading nail is sequentially lifted outwardly of the leading edge wall while being oriented in the corresponding one of the first and second inclination lines. A linking arm includes a connected end secured to the leading edge wall, and an anchoring end pivotally mounted on the barrel about a pivot axis such that the leading nail is lifted into the feeding region through the access opening, and such that the nail magazine is turnable about the pivot axis between first and second angular positions, where the first and second inclination lines of the leading nail of the selected rank are aligned with the impacting line, respectively. An adjustably retaining member is disposed to releasably arrest movement of the nail magazine relative to the distal segment in either one of the first and second angular positions.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
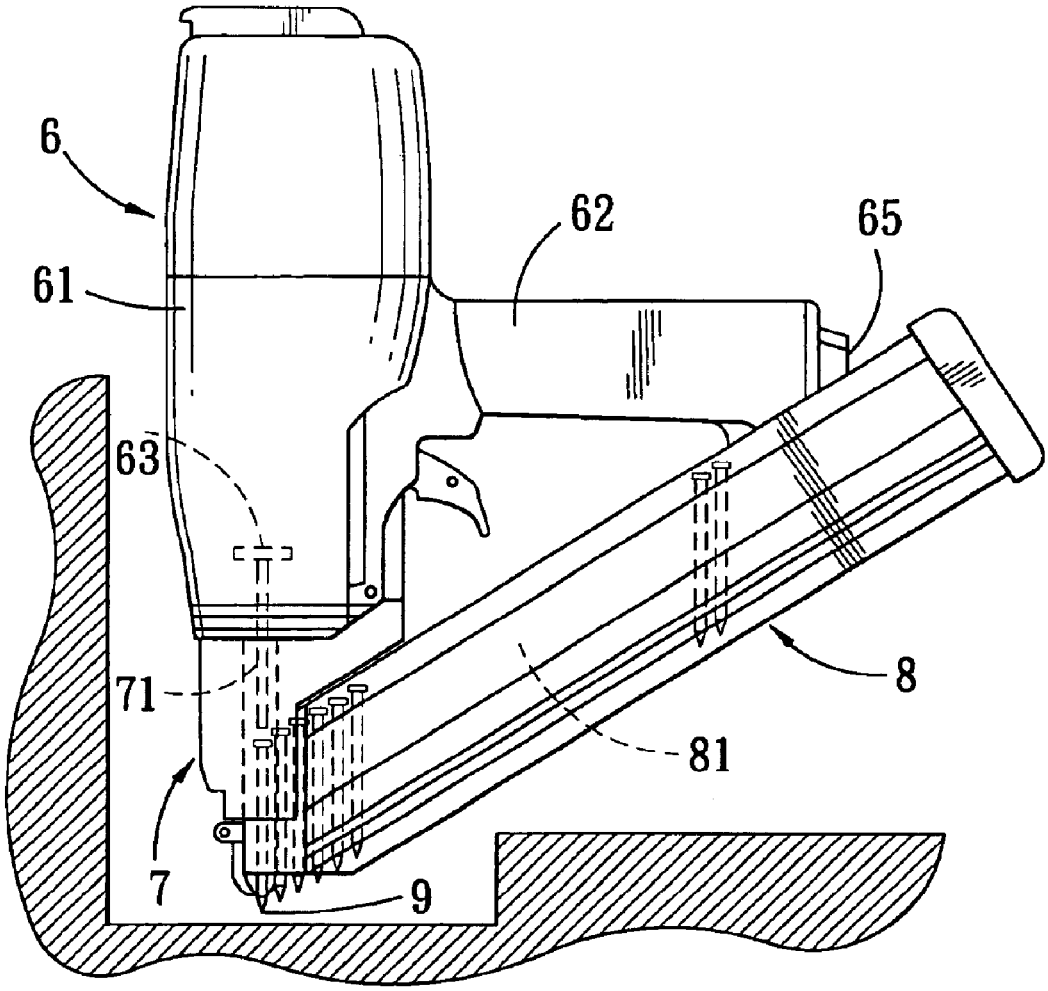
FIG. 1 PRIOR ART
FIG. 1 is a schematic view of a conventional powered nail-driving tool.
Figure 2:
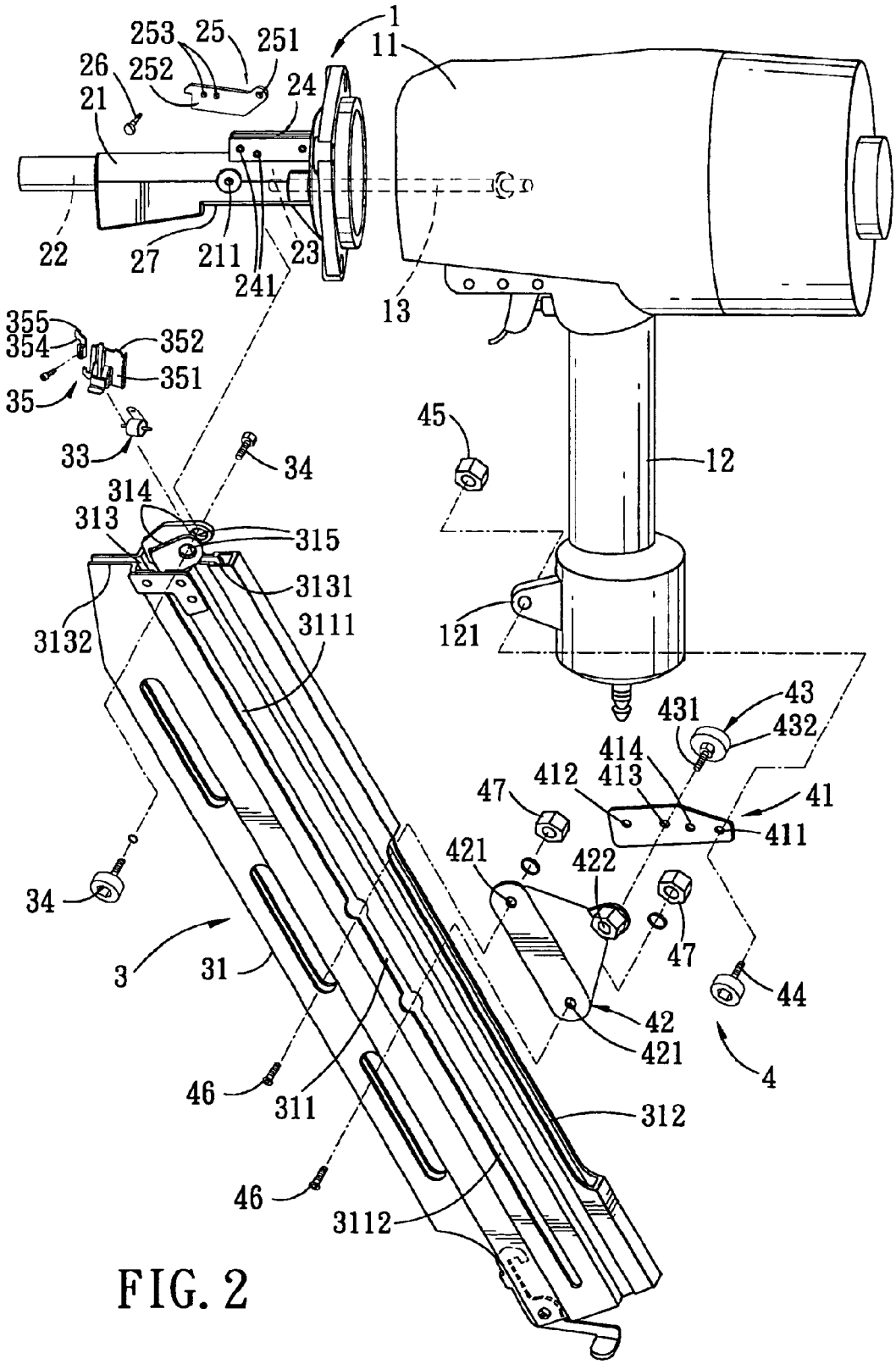
FIG. 2 is an exploded perspective view of the preferred embodiment of a powered nail-driving tool according to this invention.
Figure 3:
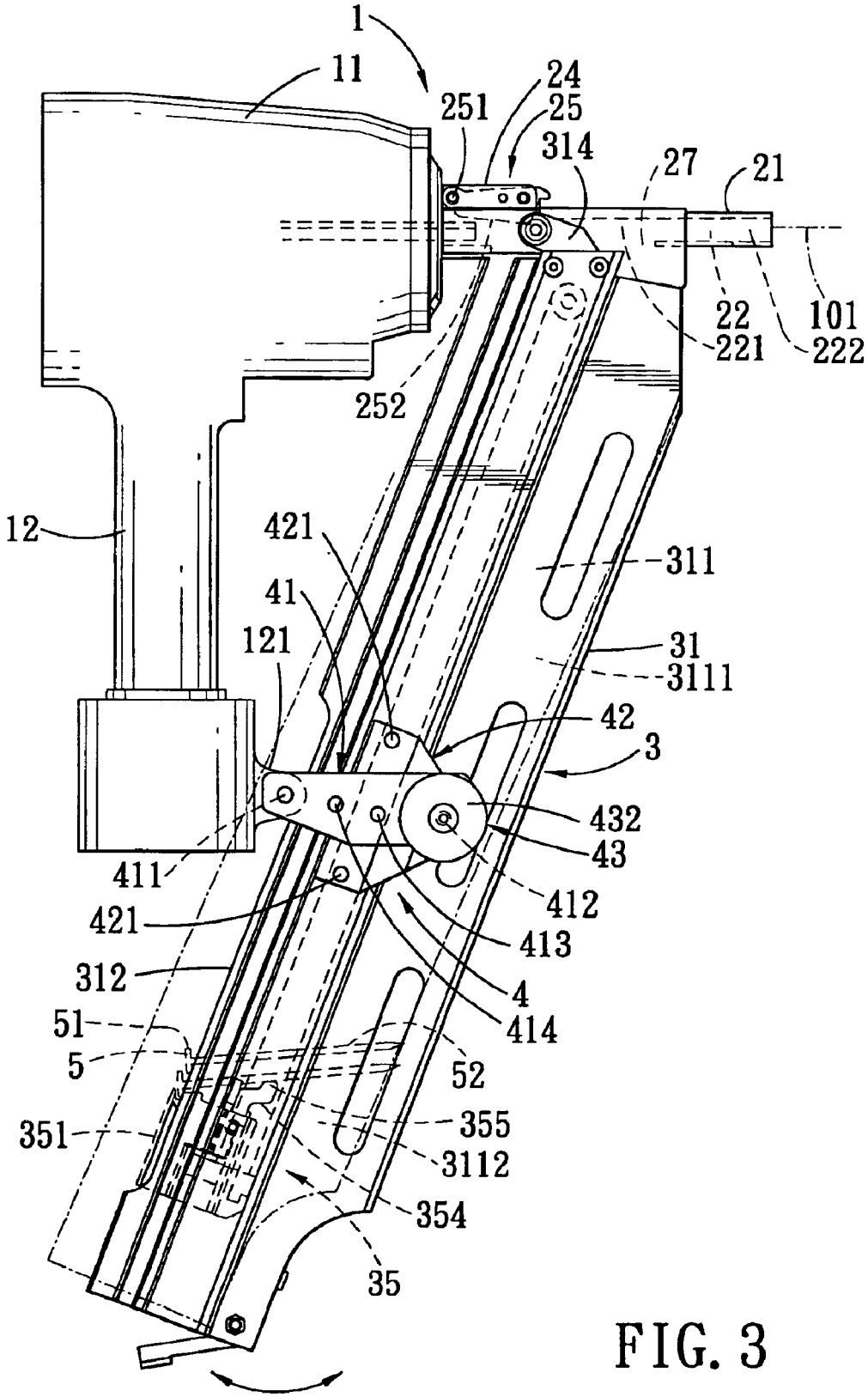
FIG. 3 is a schematic side view of the preferred embodiment.
Figure 4:
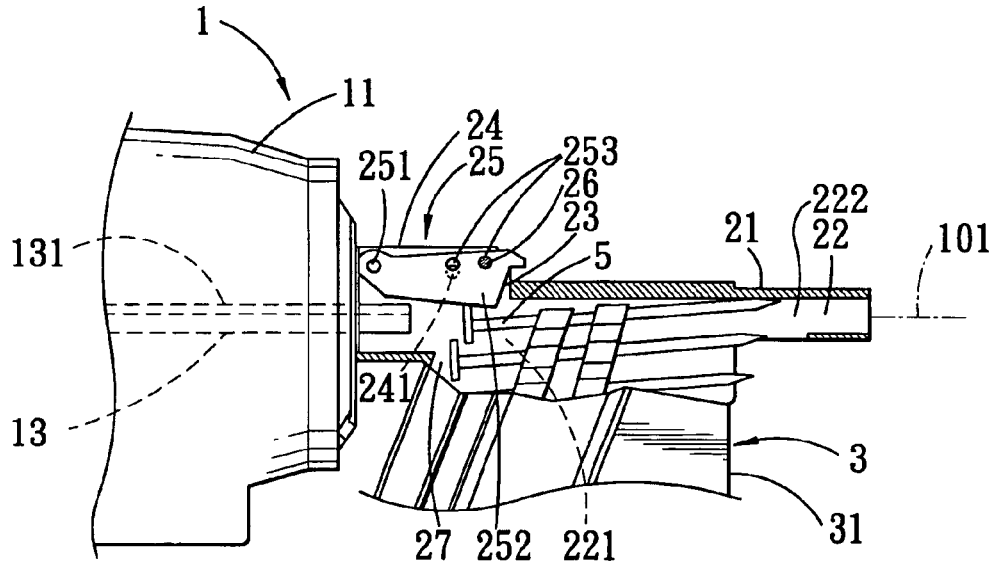
FIGS. 4 and 5 are fragmentary schematic views showing a barrier plate of a depth adjusting mechanism of the preferred embodiment in first and second depth positions, respectively.
Figure 5:
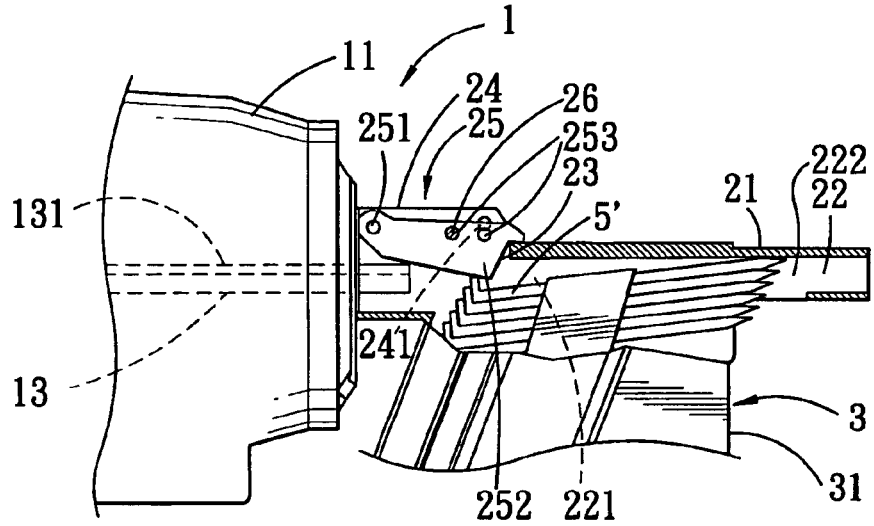
Figure 9:
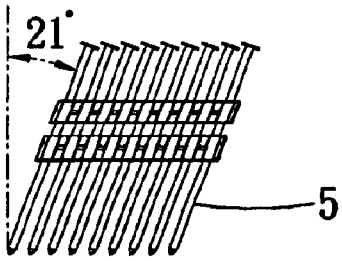
FIGS. 9 to 11 are schematic views of ranks of nails arranged to be oriented along first, second and third inclination lines that with an angle of 21, 28 and 34 degrees, respectively.
Figure 10:
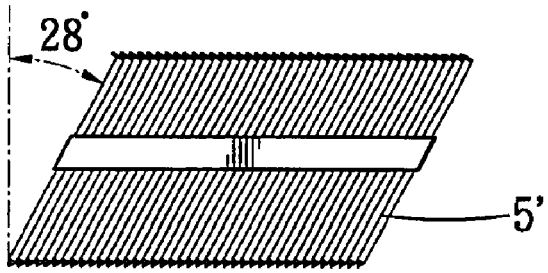
Figure 11:
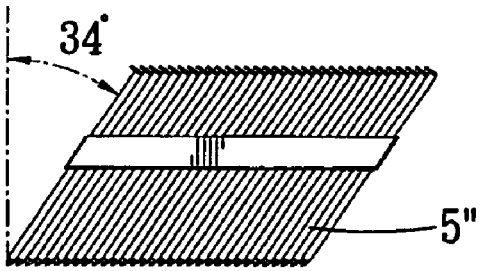
Figure 12:
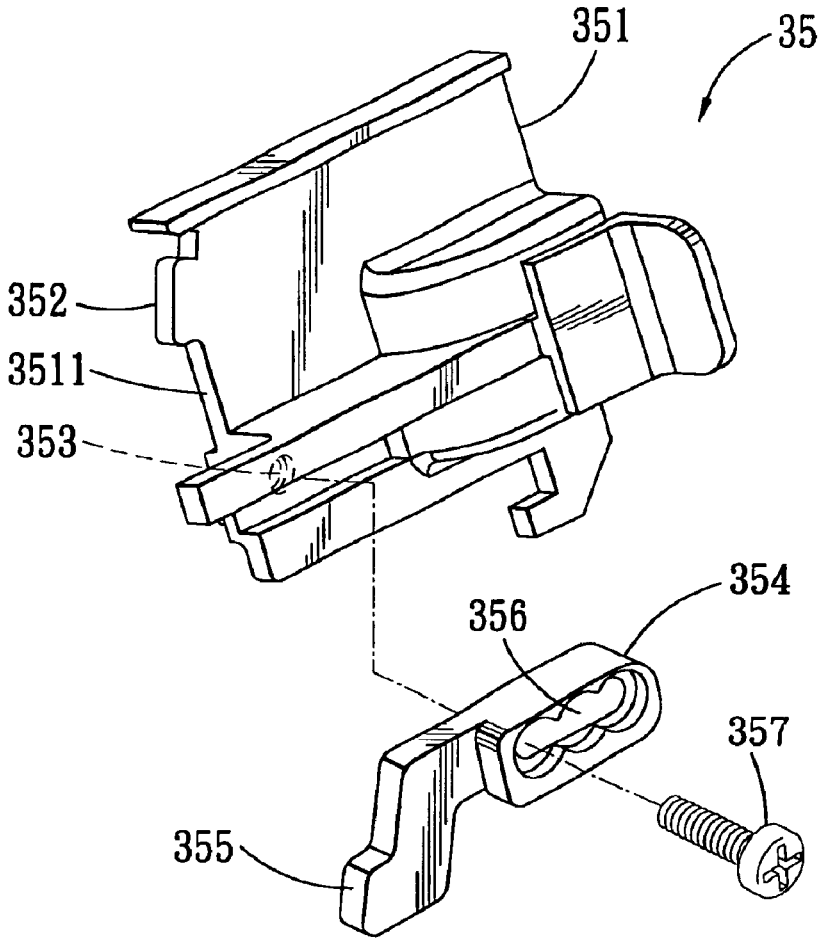
FIG. 12 is an exploded perspective view of a torque-adjustable biasing member of the preferred embodiment.
Figure 13:
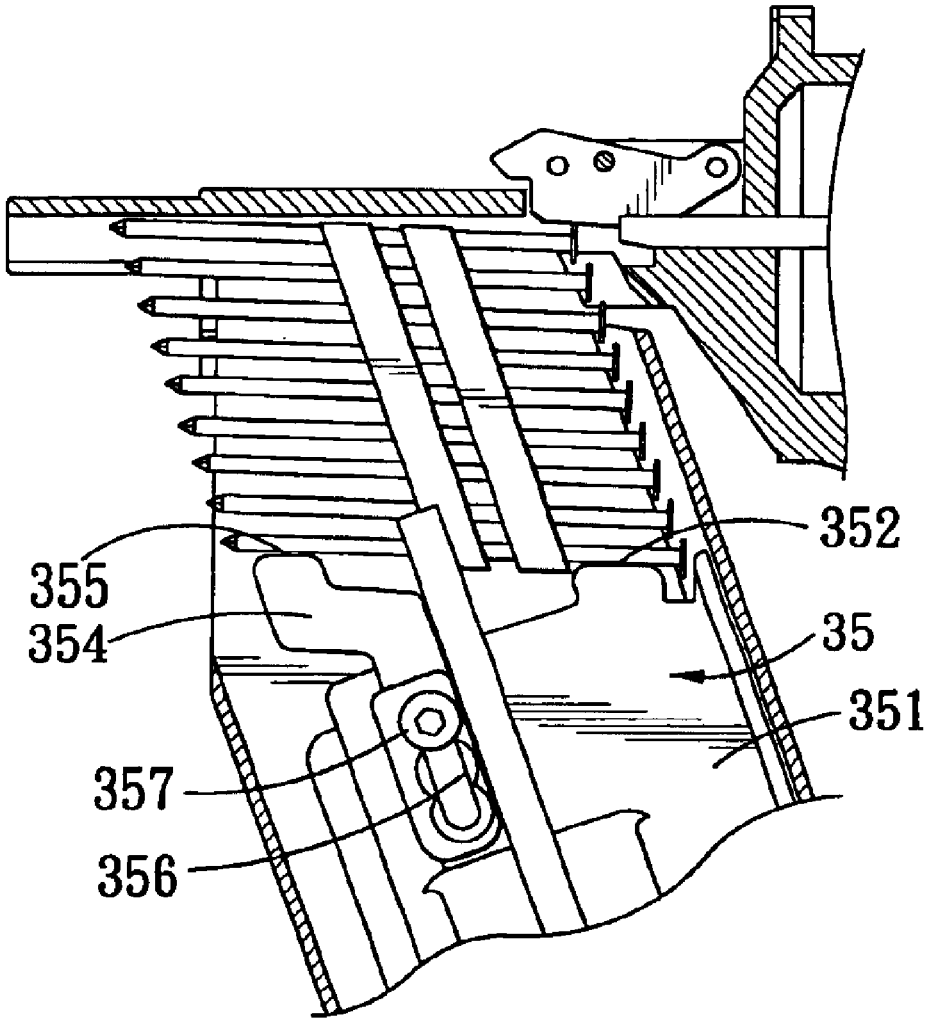
FIG. 13 is a fragmentary sectional view showing how the torque-adjustable biasing member abuts against the nails in a nail magazine.

Referring to FIGS. 2 and 3, the preferred embodiment of a powered nail-driving tool according to the present invention is suitable for driving a leading nail of a selected rank of nails 5,5',5" (see FIGS. 9 to 11). The nails 5,5',5" of each rank are juxtaposed, and are coupled to one another by means of plastic or paper tapes such that each rank of nails 5,5',5" are arranged to be oriented along a respective one of first, second and third inclination lines, such as that with an angle of a respective one of 21, 28 and 34 degrees.

The powered nail-driving tool of this embodiment is shown to comprise a body 1 which includes a barrel 21 and a shell 11 opposite to each other along an impacting line 101. The barrel 2 defines a nail-discharging passage 22 which extends along the impacting line 101, and has feeding and guiding regions 221,222 proximate to and distal from the shell 11, respectively. The barrel 21 has an access opening 27 which is communicated with the feeding region 221 in a radial direction relative to the impacting line 101, and which is adapted to admit entry of the leading nail 5 into is the feeding region 221.

A striking rod 13 is disposed in the shell 11, and is thrust into the feeding region 221 along the impact line 101 in response to a manual operation to thereby force the leading nail 5 through the guiding region 222 and out of the barrel 21 for nailing. Since the striking rod 13 is of a known type, a description thereof is dispensed with herein for the sake of brevity.

A handle 12 is formed integrally with and extends radially from the shell 11, and includes proximate and distal segments relative to the shell 11. The distal segment has a lug 121.

A nail magazine 3 includes a magazine body 31 which has a leading edge wall 313 that extends in a longitudinal direction, and which has proximate and distal edge ends 3131,3132 opposite to each other in the longitudinal direction. A nail-feeding channel 311 is elongated in a transverse direction relative to the longitudinal direction, has a proximate storing zone 3111 adjacent to the leading edge wall 313 and a distal storing zone 3112 opposite to the proximate storing zone 3111 in the transverse direction, and is adapted to accommodate the selected rank of nails 5 in such a manner that a head 51 and a pointed end 52 of the leading nail 5 can be adjacent to the proximate and distal edge ends 3131,3132, respectively. A loading port 312 is formed in the magazine body 31 proximate to the distal storing zone 3111 for loading the nails 5.

With reference to FIGS. 2, 3, 12 and 13, a torque-adjustable biasing member 35 includes a sliding block 351 which is disposed in the distal storing zone 3112 of the nail-feeding channel 311, and is slidable towards the proximate storing zone 3111. The sliding block 351 includes a forward edge wall 3511 which is adapted to confront a trailing nail 5 of the selected rank of nails 5. A first abutment member 352 extends from the forward edge wall 3511, and is disposed to abut against the head 51 of the trailing nail 5. A movable body 354 includes a second abutment member 355 which is disposed opposite to the first abutment member 355 in the longitudinal direction, and is movable relative to the sliding block 351 in the transverse direction such that the second abutment member 355 is position-adjustable relative to the forward edge wall 3511 in the transverse direction between fully, middle and partially extended positions that correspond to the first, second and third inclination lines. In particular, a screw hole 353 and a positioning slot 356 are formed in the sliding block 351 and the movable body 354, respectively. The positioning slot 356 defines three positions which correspond to the fully, middle and partially extended positions, respectively. A screw fastener 357 is positioned in one of the positions and engages threadedly the screw hole 353 so as to position the second abutment member 355 relative to the first abutment member 352. A biasing unit 33 has an end secured to the nail-feeding channel 311 adjacent to the leading edge wall 313, and is disposed to bias the sliding block 351 towards the proximate storing zone 3111. Therefore, the torque-adjustable biasing member 35 can urge against the trailing nail 5 of the selected rank such that the leading nail 5 of the selected rank is sequentially lifted outwardly of the leading edge wall 313 while being oriented in the corresponding inclination line.

A linking arm 314, which is in the form of two lugs, includes a connected end secured to the leading edge wall 313 of the magazine body 31, and an anchoring end pivotally mounted on the barrel 21 about a pivot axis by means of screw fasteners 34 that pass through axial holes 315 formed in the anchoring end and that engage the lock hole 211 formed in the barrel 21. As such, the nail magazine 3 is turnable about the pivot axis among first, second and third angular positions, where the first, second and third inclination lines of the selected leading nails 5,5',5" are aligned with the impacting line 101, respectively, once either one of the selected leading nails 5,5',5" is lifted into the feeding region 221 through the access opening 27.

An adjustably retaining member 4 includes a first retaining portion 41 which has a secured end secured to the lug 121 by a screw fastener 44 that passes through a hole 411 formed in the secured end and that is engaged threadedly with a screw nut 45, and a coupled end with first, second and third through holes 412,413,414 in corresponding to the first, second and third angular positions, respectively, and a second retaining portion 42 which has a secured end secured to the magazine body 31 by two screw fasteners 46 that pass through two holes 421 formed in the secured end and that are engaged threadedly with two screw nuts 47, and a coupled end with a screw bore 422. A screw fastener 43 includes a threaded shank 431 which passes through a selected one of the first, second and third through holes 412,413,414 and which engages threadedly the screw bore 422 so as to arrest the nail magazine 3 in the corresponding one of the first, second and third angular positions, and a rotary knob 432 which is disposed for manual operation.

As illustrated, by releasing the screw fastener 34, the nail magazine 3 can be turned about the pivot axis so as to be retained to a selected one of the first, second and third angular positions to permit alignment of the inclination line of the selected rank of nails 5,5',5" with the impacting line 101, thereby resulting in smooth forced passage of the leading nail 5,5',5" through the guiding region 222 and out of the barrel 21 for nailing.

Figure 8:
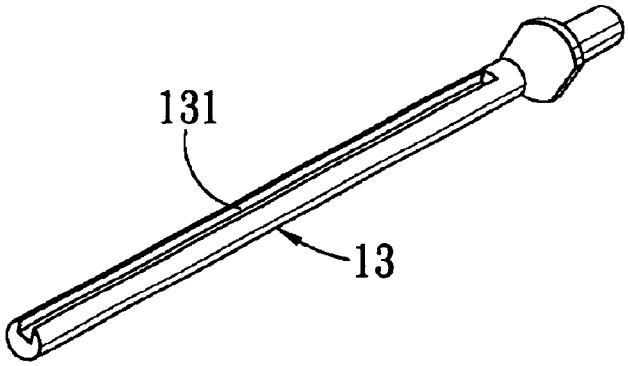
FIG. 8 is a perspective view of a striking rod of the preferred embodiment.

Moreover, since the ranks of nails 5,5',5" have a variety of heads so that the distance between two adjacent nails 5,5',5" of each rank is different, a depth adjusting mechanism is provided to ensure that only one nail 5,5',5" (i.e. the leading nail) is brought to enter the feeding region 221 to align with the impacting line 101 at each impacting action of the striking rod 13. As shown in FIGS. 2 to 5, the depth adjusting mechanism includes an insert hole 23 which is formed in the barrel 21, which is diametrically opposite to the access opening 27 relative to the impacting line 101, and which is communicated with the feeding region 221. Two lugs 24 are disposed on the barrel 21 at two opposite sides of the insert hole 23. A barrier plate 25 has a connected end 251 pivotally mounted on the lugs 24, and a barrier end 252 which is turnable relative to the connected end 251 and which extends radially into the feeding region 221 through the insert hole 23 so as to sit on the head of the selected leading nail 5,5'. For example, referring to FIGS. 4 and 5, the barrier end 252 is turnable towards the impacting line 101 from a first depth position that corresponds to the first inclination line of the rank of nails 5, to a second depth position that corresponds to the second inclination line of the rank of nails 5' so as to ensure an accurate alignment of the selected one of the first and second inclination lines of the leading nails 5,5' with the impacting line 101. A retaining member includes a plurality of through holes 253 formed in the barrier end 252, a plurality of through holes 241 formed in the lugs 24, and a fastener 26 which can pass through a predetermined one of the through holes 241 and the corresponding through hole 253 so as to arrest the barrier end 252 of the barrier plate 25 at the desired depth position. Moreover, with reference to FIG. 8, the striking rod 13 has a groove 131 which is configured to accommodate relative movement of the barrier end 252 of the barrier plate 25 thereto along the impacting line 101 when the striking rod 13 is thrust into the feeding region 221 such that the forcing of the leading nail 5,5',51, through the guiding region 222 is not interfered by the barrier plate 25 when the barrier end 252 is in one of the depth positions.

Figure 6:
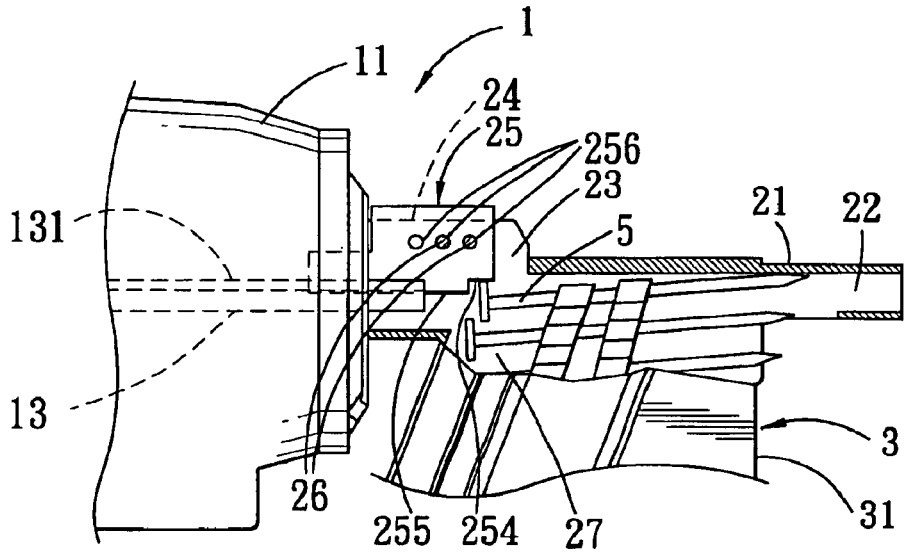
FIGS. 6 and 7 are fragmentary schematic views showing another barrier plate of the preferred embodiment in first and second depth positions, respectively.
Figure 7:
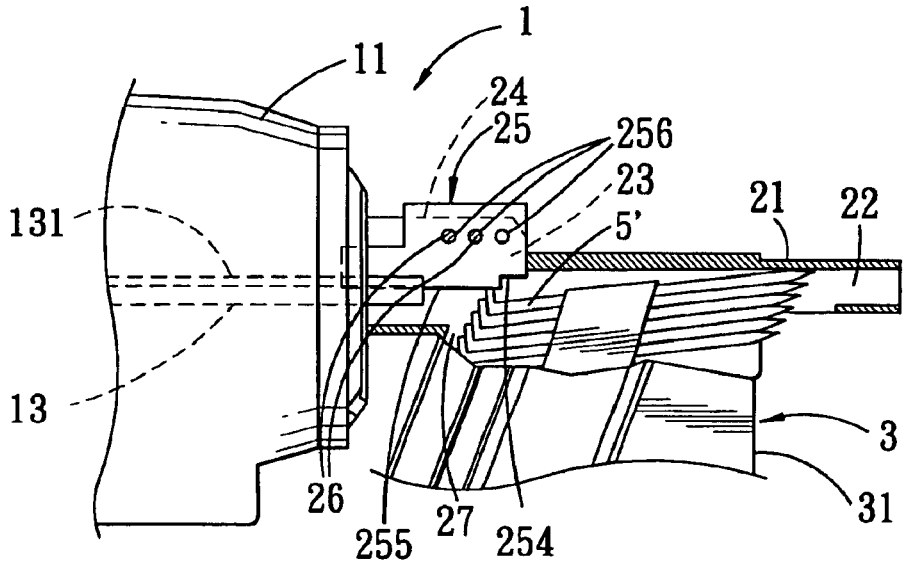

Alternatively, referring to FIGS. 6 and 7, another type of the barrier plate 25 is shown to have a barrier end which includes lower and higher segments 255,254 opposite to each other in the longitudinal direction, and proximate to and distal from the access opening 27 in the radial direction, respectively. The barrier plate 25 is slidable relative to the lugs 24 in the longitudinal direction such that in either one of the first and second depth positions, a respective one of the lower and higher segments 255,254 is adapted to sit on the head of the selected leading nail 5,5'. In the second depth position shown in FIG. 7, the lower segment 255 can also be disposed to sit on the head of the leading nail 5". The barrier plate 25 has three through holes 256 aligned with one another in the longitudinal direction such that two fasteners 26 can pass through the holes 241 in the lugs 24 and two of the through holes 256 to arrest the barrier plate 25 at the desired depth position.

As illustrated, the powered nail-driving tool of this invention is suitable for any rank of nails 5,5',5" oriented along different inclination lines, and can ensure alignment of the leading nail 5,5',5" in the feeding region 221 with the impacting line 101, thereby enabling the striking rod 13 to precisely force the leading nail 5,5',5" out of the barrel 2.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A powered nail-driving tool suitable for driving a leading nail from a selected one of two different ranks of juxtaposed nails, the two different ranks being oriented along first and second lines of inclination, respectively, said powered nail-driving tool comprising:

a body including a barrel and a shell opposite to each other along an impacting line, said barrel defining a nail-discharging passage which extends along the impacting line, and which has feeding and guiding regions proximate to and distal from said shell, respectively, said barrel having an access opening which is communicated with said feeding region in a radial direction relative to the impacting line, and which is adapted to admit entry of the leading nail into said feeding region;

a striking rod which is disposed in said shell, and which is thrust into said feeding region along the impact line in response to a manual operation to thereby force the leading nail through said guiding region and out of said barrel for nailing;

a handle which extends radially from said shell, and which includes proximate and distal segments relative to said shell;

a nail magazine including:

a leading edge wall which extends in a longitudinal direction, and which has proximate and distal edge ends opposite to each other in the longitudinal direction, a nail-feeding channel which is elongated in a transverse direction relative to the longitudinal direction, which has a proximate storing zone adjacent to said leading edge wall and a distal storing zone opposite to said proximate storing zone in the transverse direction, and which is adapted to accommodate the selected one of two different ranks of nails oriented along a corresponding one of the first and second inclination lines in such a manner that a head and a pointed end of the leading nail are respectively adjacent to said proximate and distal edge ends, and a torque-adjustable biasing member adapted to urge against a trailing nail of the selected one of the two different ranks of nails oriented along a corresponding one of the first and second inclination lines such that the leading nail of the selected rank is sequentially lifted outwardly of said leading edge wall while being oriented in the corresponding one of the first and second inclination lines;

a linking arm including a connected end secured to said leading edge wall, and an anchoring end pivotally mounted on said barrel about a pivot axis such that the leading nail of the selected rank is lifted into said feeding region through said access opening, and such that said nail magazine is turnable about the pivot axis between a first angular position, where the first inclination line of the leading nail of the selected rank is aligned with the impacting line, and a second angular position, where the second inclination line of the leading nail of the selected rank is aligned with the impacting line; and an adjustably retaining member disposed to releasably arrest movement of said nail magazine relative to said distal segment in either one of the first and second angular positions.

2. The powered nail-driving tool of claim 1, wherein said adjustably retaining member includes first and second retaining portions which respectively have secured ends that are respectively secured to said distal segment of said handle and said nail magazine, and coupled ends that are adjustably coupled with each other so as to releasably arrest movement of said nail magazine relative to said distal segment in either one of the first and second angular positions.

3. The powered nail-driving tool of claim 2, wherein said adjustably retaining member further has first and second through holes formed in said coupled end of said first retaining portion in corresponding to the first and second angular positions, respectively, a screw bore formed in said coupled end of said second retaining portion, and a screw fastener which is disposed to pass through a selected one of said first and second through holes and which engages threadedly said screw bore so as to arrest said nail magazine in the corresponding one of the first and second angular positions.

4. The powered nail-driving tool of claim 1, wherein said torque-adjustable biasing member includes a sliding block disposed in said distal storing zone of said nail-feeding channel, and slidable towards said proximate storing zone, said sliding block including a forward edge wall adapted to confront the trailing nail of the selected rank of nails, a first abutment member extending from said forward edge wall, and disposed to abut against the head of the trailing nail, a second abutment member which is disposed opposite to said first abutment member in the longitudinal direction, and which is configured to be position-adjustable relative to said forward edge wall in the transverse direction between fully and partially extended positions that correspond to the first and second inclination lines, and a biasing unit disposed to bias said sliding block towards said proximate storing zone.

5. The powered nail-driving tool of claim 1, wherein said barrel further has an insert hole which is formed diametrically opposite to said access opening relative to the impacting line and which is communicated with said feeding region, and a barrier plate which has a connected end connected to said barrel, and a barrier end which extends radially into said feeding region through said insert hole so as to sit on the head of the selected leading nail, and which is shiftable towards the impacting line between first and second depth positions that correspond to the first and second inclination lines, respectively, so as to ensure an accurate alignment of the selected one of the first and second inclination lines of the leading nails with the impacting line.

6. The powered nail-driving tool of claim 5, wherein said connected end of said barrier plate is pivotally mounted on said barrel such that said barrier end is turnable relative to said barrel between the first and second depth positions, said barrel further having a retaining member which is disposed to retain said barrier plate to said barrel so as to arrest said barrier end in a selected one of the first and second depth positions.

7. The powered nail-driving tool of claim 5, wherein said barrier end of said barrier plate has lower and higher segments opposite to each other in the longitudinal direction, and proximate to and distal from said access opening in the radial direction, respectively, said barrier plate being slidable relative to said barrel in the longitudinal direction such that in either one of the first and second depth positions, a respective one of said lower and higher segments is adapted to sit on the head of the selected leading nails.

8. The powered nail-driving tool of claim 5, wherein said striking rod has a groove configured to accommodate relative movement of said barrier end of said barrier plate thereto along the impacting line when said striking rod is thrust into said feeding region such that forcing of the leading nail through said guiding region is not interfered by said barrier plate when said barrier end is in either one of the first and second depth positions.

* * * * *